US009869527B2

(12) United States Patent
Hancosky

(10) Patent No.: US 9,869,527 B2
(45) Date of Patent: Jan. 16, 2018

(54) SUPPLEMENTARY SIGHT AID ADAPTABLE TO EXISTING AND NEW SIGHT AID

(71) Applicant: Jack Hancosky, Avoca, NY (US)

(72) Inventor: Jack Hancosky, Avoca, NY (US)

(73) Assignee: Precision Accuracy Solutions, Inc., Webster, NY (US)

( * ) Notice: Subject to any disclaimer, the term of this patent is extended or adjusted under 35 U.S.C. 154(b) by 0 days.

(21) Appl. No.: 15/090,877

(22) Filed: Apr. 5, 2016

(65) Prior Publication Data

US 2016/0216069 A1 Jul. 28, 2016

Related U.S. Application Data

(63) Continuation-in-part of application No. 14/569,637, filed on Dec. 13, 2014, now Pat. No. 9,328,995.

(51) Int. Cl.
*F41G 1/38* (2006.01)
*F41G 1/34* (2006.01)

(52) U.S. Cl.
CPC ..... *F41G 1/38* (2013.01); *F41G 1/345* (2013.01)

(58) Field of Classification Search
CPC .... F41G 3/005; F41G 1/01–1/02; F41G 1/06; F41G 1/16–1/17; F41G 1/30; F41G 1/32; F41G 1/34; F41G 1/345; F41G 1/38; F41G 1/42; F41G 1/425
USPC ..... 42/119–120, 122–123, 130–131, 42/140–141, 113
See application file for complete search history.

(56) References Cited

U.S. PATENT DOCUMENTS 2,603,874 A * 7/1952 Stewart ..... F41G 1/033 42/140
2,904,888 A * 9/1959 Niesp ..... F41G 1/473 42/141
5,052,790 A * 10/1991 Edwards ..... G02B 21/0008 359/399
5,065,538 A * 11/1991 Allen ..... F41G 1/42 42/142
5,189,560 A * 2/1993 Edwards ..... F41G 1/38 359/428
6,336,285 B1 * 1/2002 Baumer ..... F41G 1/00 42/113
6,421,946 B1 * 7/2002 LoRocco ..... F41G 1/16 42/111
6,796,037 B1 * 9/2004 Geffers ..... F41G 1/467 124/87

(Continued)

*Primary Examiner* — Stephen Johnson
*Assistant Examiner* — Benjamin S Gomberg
(74) *Attorney, Agent, or Firm* — Tracy Jong Law Firm; Tracy P. Jong; Cheng Ning Jong

(57) ABSTRACT

A sight aid including a supplementary sight alignment indicator having a projection plane and a projection device adapted to project a supplementary sight alignment indicator and at least one reference point on the projection plane, the supplementary sight alignment indicator is axially-centered with respect to the sight alignment indicator and spaced apart therefrom on the optical axis for forming a composite image with the image of the sight alignment indicator, the target image being viewable together by the user by means of the ocular lens and the projection plane is disposed at a distance from the sight alignment indicator. An adaptor secures the supplementary sight alignment indicator to a portion of the projectile device or the housing.

3 Claims, 6 Drawing Sheets

(56) References Cited

U.S. PATENT DOCUMENTS

| | | | | |
|---|---|---|---|---|
| 6,860,056 | B2 * | 3/2005 | Howe | F41G 1/01 42/132 |
| 6,865,022 | B2 | 3/2005 | Skinner et al. | |
| 7,503,122 | B2 * | 3/2009 | Afshari | F41G 1/467 124/87 |
| 8,286,383 | B2 * | 10/2012 | Matthews | F41G 1/38 42/121 |
| 8,769,858 | B2 | 7/2014 | Hancosky | |
| 8,835,855 | B2 * | 9/2014 | Ikeda | G01J 5/10 250/347 |
| 8,857,714 | B2 * | 10/2014 | Benson | G05B 1/01 235/400 |
| 8,950,102 | B1 * | 2/2015 | Reardon | F41G 1/54 42/120 |
| 9,229,214 | B1 * | 1/2016 | Lindlau | G02B 23/00 |
| 9,523,556 | B2 * | 12/2016 | Grace, Jr. | F41G 1/467 |
| 2003/0079396 | A1 * | 5/2003 | Brown | F41G 1/345 42/133 |
| 2004/0025397 | A1 * | 2/2004 | Malley | F41G 1/38 42/122 |
| 2010/0077645 | A1 * | 4/2010 | LoRocco | F41G 1/467 42/113 |
| 2012/0102808 | A1 * | 5/2012 | Matthews | F41G 1/30 42/113 |
| 2012/0126001 | A1 * | 5/2012 | Justice | F41G 1/38 235/404 |
| 2012/0198750 | A1 * | 8/2012 | Mansfield | F41G 1/01 42/132 |
| 2014/0002812 | A1 * | 1/2014 | Kepler | G01B 11/272 356/138 |

* cited by examiner

FIG. 11
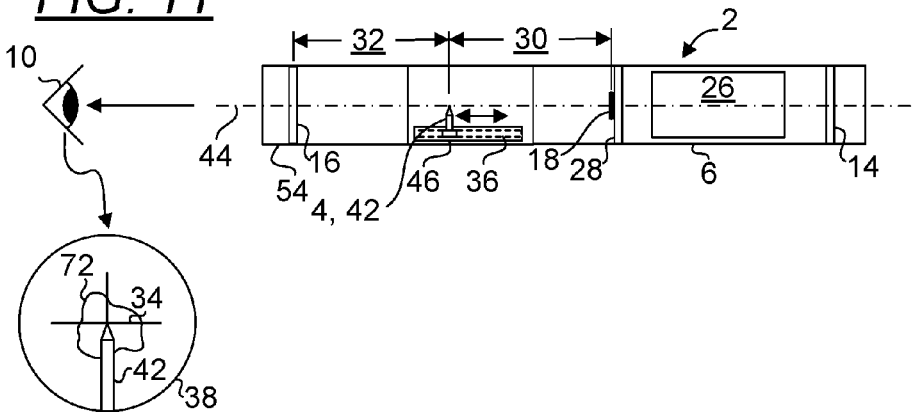
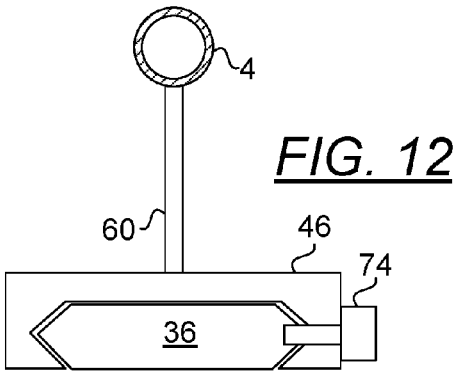
FIG. 12
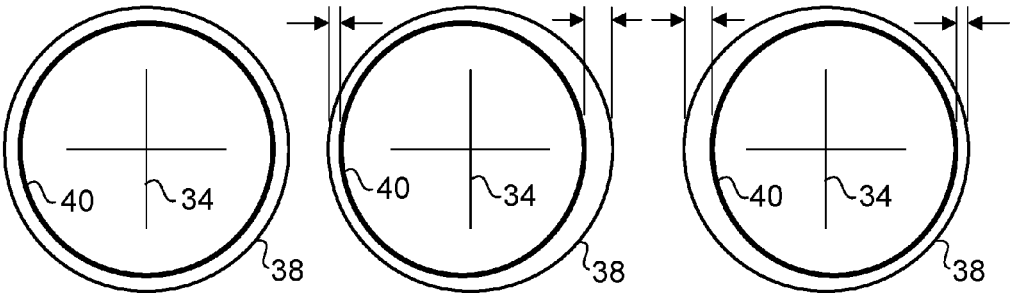
FIG. 13 FIG. 14 FIG. 15

SUPPLEMENTARY SIGHT AID ADAPTABLE TO EXISTING AND NEW SIGHT AID

PRIORITY CLAIM AND RELATED APPLICATIONS

This continuation-in-part patent application claims the benefit of priority from non-provisional application U.S. Ser. No. 14/569,637 filed on Dec. 13, 2014. Said application is incorporated by reference in its entirety.

BACKGROUND OF THE INVENTION

1. The Field of the Invention

The present invention is directed generally to an aiming device adaptable to a projectile device. More specifically, the present invention is directed to an aiming device adaptable to a projectile device and replaces the functionality of an iron sight or enhances aiming when utilized in conjunction with conventional aiming devices, e.g., scope, etc.

2. Background Art

An iron sight of a projectile device, when viewed through a scope of the projectile device, does not appear or cannot be picked up in the sight pictures of the scope. Without a scope, an iron sight may be used for rough aiming. The practice of using an iron sight to align a projectile device with a target can be difficult and eye-straining and produces unsatisfactory alignments at best. The act of maintaining such alignment can also be challenging and not effective as the user must ultimately keep his aim on the target while viewing the iron sight. Further, the precise alignment of an iron sight is not possible as the iron sight lacks a mechanism which indicates the vertical alignment of the line of sight.

Various other attempts have been made for aiding aiming, however none of which have produced satisfactory results. For instance, U.S. Pat. No. 6,865,022 to Skinner, et al. (Hereinafter Skinner) discloses an improved reticle for optical instruments such as telescopic sights, riflescopes and surveying telescopes, the improved reticle provides a primary indicator at the focal plane of the instrument and a secondary indicator spaced, axially, apart from, and viewable with, the primary indicator. When an operator's eye is properly centered on the optical axis of the instrument, the indicators provide visual feedback to the operator from improved alignment. According to Skinner, when an operator's eye is laterally displaced from the optical axis, the indicators provide visual feedback indicative of improper positioning of the eye. Thus, an operator may readily, and intuitively, make the necessary adjustments to the relationship of the eye to the optical axis to correct for misalignment without the need for cumbersome mechanical adjustments and special mechanisms. Skinner's secondary indicator is disposed in close proximity to the indicator of the primary reticle, rendering any alignment that results from using such reticles not as effective as the reticles spread apart at much greater distances. Further, Skinner fails to disclose using any indicators made of attention-getting colors, substances, illuminations, e.g., fluorescent, laser, Light Emitting Diodes (LEDs), etc. Riflescopes have an eye relief of about three inches to allow adequate space between the rear of the scope and the shooter's eye so that, when the rifle is discharged, the apparatus does not travel far enough back under recoil to strike the shooter's face. Although Skinner's device may be adequate in allowing sufficient distance in the scope and the user for recoil, if an enhanced attention-getting device is provided, this distance can be extended, providing additional safe distance to the user. This is important for new rifle users as they may not maintain proper distances between their eye and the scope of the rifle.

In another example, aiming of a target is aided by projecting one or more laser beams onto the target. The projection of beams on target require a significant amount of power which must be replenished frequently for continued service. The projection of markings or indicators within a scope or the vicinity of the scope requires little power, thereby allowing a mobile power source adapted to the projection device to be long-lasting and the frequency at which the power source is required to be replenished can be reduced.

Thus, there is a need for a sight aid capable of being incorporated in existing scopes or purpose-built scopes, where the sight aid helps a user in achieving more precise aiming and doing so without requiring custom-built or costly parts. There is also a need for a sight aid which enhances the process by which an alignment is obtained and the process by which an alignment is deemed obtained.

SUMMARY OF THE INVENTION

In accordance with the present invention, there is provided a method for aiding aiming of a projectile device with respect to a target, the projectile device functionally coupled with a telescope having a primary sight alignment indicator carried in a reticle, an objective lens and an optical axis, the method comprising:

(a) providing a sight aid having an illuminated supplementary sight alignment indicator;

(b) disposing the sight aid forward of the objective lens such that the illuminated supplementary sight alignment indicator is centrally located with respect to the optical axis and said supplementary sight alignment indicator is disposed at a distance from the primary sight alignment indicator;

(c) pointing the telescope at the target;

(d) centering an image of the target on the optical axis; and (e) centering a composite image of the primary sight alignment indicator and the supplementary sight alignment indicator to one another and the image of the target so as to perfect aim of the scope with respect to the target.

In one embodiment, there is further provided a sight aid for aiding aiming and zeroing of a projectile device with respect to a target. The sight aid is adaptable to a telescope having a housing, an objective lens mounted in the housing at one end thereof for forming a target image and an ocular lens mounted in the housing at opposite end thereof and image-erecting optics. The objective and ocular lenses define an optical axis through the housing and the image-erecting optics are mounted between the objective and ocular lenses on the optical axis for erecting the image formed by the objective lens, the ocular lens sharing a plane of focus on the optical axis where the erected image is formed for viewing by a user. A reticle is mounted within the housing on the plane of focus, the reticle having a sight alignment indicator on the optical axis, an image thereof being viewable together with the target image formed by the objective lens and the image-erecting optics within the housing to facilitate alignment of the telescope with the target. The sight aid includes a projection plane and a projection device adapted to project a supplementary sight alignment indicator and at least one reference point on the projection plane, the supplementary sight alignment indicator is axially-centered with regard to the sight alignment indicator and spaced apart therefrom on the optical axis for forming a composite image with the image of the sight alignment indicator, the target image being viewable together by the user by means of the ocular lens and the projection plane is disposed at a distance from the sight alignment indicator. The distance is preferably at least about 3 inches. Each reference point is a projected image including a cross, a dot, a ring, a triangle or any combinations thereof.

The sight aid also includes an adaptor configured to secure the sight aid to a portion of the projectile device or the housing. The images of the sight alignment indicator and supplementary sight alignment indicators are aligned by the user to eliminate parallax error relative to the target image to assure accurate alignment of the optical axis of the telescope with the target. In addition to the sight aid, there is further provided at least one reference point configured for superimposing at least one pre-printed reference point in the line of sight of a user. In one embodiment, the adaptor includes screw type threads adapted to be removably secured to the housing, whereby the supplementary sight alignment indicator is axially-centered with regard to the sight alignment indicator. In one embodiment, the adaptor includes a rail adaptor adapted to be removably and slidingly secured to a rail, whereby the supplementary sight alignment indicator is axially-centered with respect to the sight alignment indicator.

In one embodiment, there is further provided a sight aid for aiding aiming of a projectile device with respect to a target. The sight aid is adaptable to a telescope having a housing, an objective lens mounted in the housing at one end thereof for forming a target image, an ocular lens mounted in the housing at opposite end thereof and image-erecting optics. The objective and ocular lenses define an optical axis through the housing and the image-erecting optics are mounted between the objective and ocular lenses on the optical axis for erecting the image formed by the objective lens, the ocular lens sharing a plane of focus on the optical axis where the erected image is formed for viewing by the user. A reticle is mounted within the housing on the plane of focus, the reticle having a sight alignment indicator on the optical axis, an image thereof being viewable together with the target image formed by the objective lens and the image-erecting optics within the housing to facilitate alignment of the telescope with the target. The sight aid includes:

(a) a supplementary sight alignment indicator supported on a support post;

(b) a rail adapted to slidingly and removably receive the support post, the distance along the optical axis between the ocular lens and the supplementary sight alignment indicator being adjustable so that the supplementary sight alignment indicator can be disposed on the plane of focus and is axially-centered with regard to the sight alignment indicator and spaced apart therefrom on the optical axis for forming a composite image with the image of the sight alignment indicator and the target image being viewable together by the user by means of the ocular lens and the projection plane is disposed at a distance from the sight alignment indicator, whereby the images of the sight alignment indicator and supplementary sight alignment indicator are aligned by the user to eliminate parallax error relative to the target image to assure accurate alignment of the optical axis of the telescope with the target.

In yet another embodiment, the present sight aid includes a resilient substantially circular frame comprising a supplementary sight alignment indicator, the substantially circular frame frictionally and removably mounted to an inner surface of the housing such that the supplementary sight alignment indicator is disposed on the plane of focus and is axially-centered with regard to the sight alignment indicator and spaced apart therefrom on the optical axis for forming a composite image with the image of the sight alignment indicator and the target image being viewable together by the user by means of the ocular lens and the sight aid is disposed at a distance from the sight alignment indicator.

In yet another embodiment, the present sight aid includes a first illuminated sight alignment indicator including an illumination device disposed on a support post disposed at a first end of a projectile device; and a second illuminated sight alignment indicator including an illumination device disposed on a support post disposed at a second end of the projectile device. The second illuminated sight alignment indicator is spaced apart a distance from the first illuminated sight alignment indicator. The first illuminated sight alignment indicator and the second illuminated sight alignment indicator defines an optical axis, wherein the second illuminated sight alignment indicator is axially-centered with respect to the first illuminated sight alignment indicator on the optical axis for forming a composite image of the first illuminated sight alignment indicator, the second illuminated sight alignment indicator and the target by the user. An indication of deviation of the axially-centered first illuminated sight alignment indicator and axially-centered second illuminated sight alignment indicator and the target along the optical axis is provided to the user such that an action can be taken to remove such deviation to assure accurate alignment of the optical axis with the target.

The supplementary sight alignment indicator is a projected image including a cross, a dot, a ring, a line, a pin or any combinations thereof.

In one embodiment, the projection plane is formed of transparent phosphors coating. In one embodiment, the projection device is adapted to project a laser beam onto the projection plane.

In one embodiment, the supplementary sight alignment indicator is a projected image shaped and sized substantially alike so that, when a user's eye is centered on the optical axis, the image of the sight alignment indicator completely covers the image of the supplementary sight alignment indicator.

In one embodiment, the supplementary sight alignment indicator is a projected image shaped concentrically to the sight alignment indicator so that, when a user's eye is centered on the optical axis, the image of the supplementary sight alignment indicator is centered relative to the sight alignment indicator.

An object of the present invention is to provide a sight aid useful for attracting the attention of a user's eye.

An object of the present invention is to provide a sight aid useful for attracting the attention of a user's eye such that undue effort in focusing one's eye in establishing alignment of the scope with a target can be avoided.

An object of the present invention is to provide a sight aid useful for supplementing another or existing reticle of a scope to enhance the alignment of the scope with respect to a target.

An object of the present invention is to provide a sight aid having an indicator that can be aligned along an optical axis of a scope and be adjustable along the optical axis such that the indicator can be disposed on a plane of focus.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 11 is a diagrammatic side view of another embodiment of a sight aid adapted for use with a scope, where a location adjustable sight alignment indicator is integrally attached to the scope.

FIG. 12 is a front view of a supplementary slight alignment indicator mounted on a base configured for sliding and removable attachment to a rail.

FIGS. 13-15 depict sight pictures of a scope having one reticle and one sight aid, the reticle having a set of crosshairs and the sight aid having a ring, when the user's eye is positioned on-axis and the user's eye is shifted off-axis.

PARTS LIST

Figure 1:
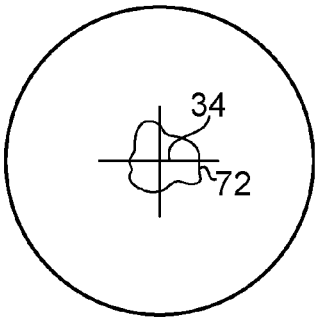
PRIOR ART FIG. 1
FIG. 1 depicts an image as viewed through a scope by a user when an iron sight is disposed well within a projected area in front of an objective lens of the scope.

2—scope
4—projected image or supplementary sight alignment indicator
6—scope housing
8—iron sight
10—view point of a user's eye
12—projection device
14—objective lens
16—ocular lens
18—primary sight alignment indicator
20—projection plane
22—hinge
24—attachment interface
26—image erecting optics
28—reticle
30—physical distance between sight alignment indicator and supplementary sight alignment indicator
32—physical distance between supplementary sight alignment indicator and ocular lens
34—crosshairs
36—rail
38—edge of image cast by objective lens
40—ring
42—post
44—optical axis
46—base
48—insertable indicator
50—frame
52—inner surface of housing
54—ocular lens cap
56—M-shaped sight alignment indicator
58—trough of M-shaped sight alignment indicator
60—support post
62—projectile device
64—height of iron sight as viewed by the user when projectile device is roughly aligned with the user's line of sight
66—rail adaptor
68—reference point
70—rib
72—target
74—lock
76—projector

PARTICULAR ADVANTAGES OF THE INVENTION

In one embodiment of the present invention where a projection device is used, the present sight aid eliminates all the limitations of the prior art and permits instantaneous, effortless target acquisition with no adjustments as the bright, illuminated indicator reduces the need for tremendously focused attention on the part of the user in aligning indicators of the reticle and the sight aid, regardless of the distance of the target from the user. Further, the power required for projecting a laser indicator locally within or in the vicinity of the scope for the benefit of the user is much less than the power required for projections of laser beams onto distant targets.

In one aspect, the present sight aid makes alignment of scope on target more precise as the present sight aid is capable of being mounted at a position spaced farther from an existing or primary reticle, thereby increasing the sensitivity at which a deviation from alignment of the reticle and the sight aid can be detected. Corrective actions can thus be taken more readily.

In one embodiment, the positioning of a present sight aid can be adjusted along the optical axis of the spaced apart existing reticle and the sight aid such that the sight aid can be positioned on the plane of focus of a scope, making the sight aid suitable to be retrofitted to an existing scope.

In one embodiment, a present sight aid is installed onto an existing scope simply by squeezing the frame of the sight aid and releasing it into a cylindrical portion of the housing of the scope, placing the indicator in the optical axis of the scope.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The term "scope" is used herein to mean a telescope, or any optical instrument capable of magnifying the image of distant objects when the optical instrument is aligned in the direction of the distant objects and when the distant objects are viewed through the ocular lens of the scope.

The term "primary sight alignment indicator" of "sight alignment indicator" is used herein to mean a reticle or a sight aid that is provided with many conventional scopes and provided in a built-in format in those conventional scopes.

Figure 2:
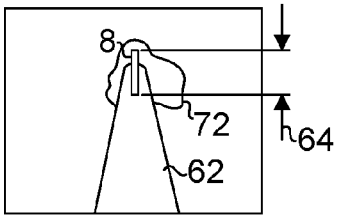
PRIOR ART FIG. 2
FIG. 2 depicts an appearance of iron sight as viewed through the ocular lens when the eye of a user is roughly centered on the optical axis of the scope.
Figure 3:
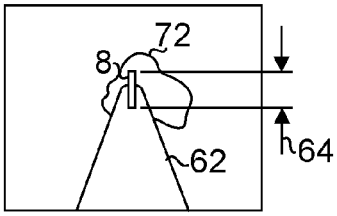
PRIOR ART FIG. 3
FIG. 3 depicts another appearance of iron sight as viewed through the ocular lens when the eye of a user is roughly centered on the optical axis of the scope.
Figure 4:
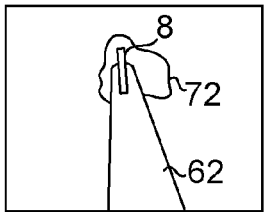
PRIOR ART FIG. 4
FIG. 4 is a view similar to that depicted in FIG. 2 but wherein the eye of a user is shifted laterally off-axis.

Iron sights have been widely used in projectile devices, e.g., rifles, shotguns, pistols, revolvers, etc., to aid aiming of such devices. An iron sight is typically disposed at the tip of a barrel of projectile device to allow as much distance between the iron sight and the user such that the user can aim more effectively. If coupled with a scope, e.g., a telescope, the combined scope and iron sight renders the iron sight useless as the iron sight will not appear through the field of view of a scope although the iron sight is physically within a projected area forward of the scope as shown in FIG. 1. Contrary to the teachings of conventional wisdom that an object disposed forward of telescope along its optical axis will be detected or block the view of the telescope, the Applicant discovered that due to the magnifying power of a common scope, an iron sight disposed along the optical axis of a projectile device is not detectable when viewed through the scope. FIG. 2 depicts an appearance of iron sight 8 as viewed by a user when a projectile device 62 is roughly aligned with the user's line of sight. FIG. 3 depicts an appearance of iron sight 8 as viewed by a user when a projectile device 62 is roughly aligned with the user's line of sight. Depending on the attitude of the eye with respect to the iron sight, from which sight pictures of FIGS. 1 and 2 are obtained, the sight pictures appear to show the same result of aiming in both cases, but yet in reality, the results can be quite different as sight pictures do not show identical images. Note that the heights 64 of iron sight as viewed by the user in FIGS. 2 and 3 are quite different. FIG. 4 is a view similar to that depicted in FIG. 1 but wherein the eye of a user is shifted laterally off-axis. The problems in using an iron sight do not lie in detecting a shift away from alignment, but rather a shift towards alignment. The ambiguity arising from the use of an iron sight, parallax error, involuntary lateral displacement of the user's eye from the optical axis and the pursuit of increased precision in alignment and ease of use contribute to the development of alternative alignment methods and apparatus.

Column 1 lines 24-47 of Skinner explains how a parallax error negatively affects the accuracy of a projectile device as follows:—

"It is well-known in the art of telescopic sights, such as riflescopes and surveying telescopes, which comprise an objective lens, or lenses, and an ocular lens, or lenses, and image-erecting optics, that images of objects at different distances from an operator, being viewed by means of the optical instrument, focus at different points along the internal optical axis of the instrument. For instance, the image of a near object being viewed by an operator through the optics of such an instrument is focused at a point somewhat more rearward (closer to the ocular end) on the optical axis than is the image of a more distant object which will focus farther away from the ocular end of the optical instrument. When the optical instrument is equipped with a fixed alignment reticle, as in the case of a riflescope, this shift in focus introduces parallax error between the image of the object and that of the reticle. This means that the axially-fixed alignment reticle will not be on the same plane as the image of the object formed by the objective lens system. In this case, if the operator's eye is not perfectly aligned with the optical axis of the instrument, the images of the object and the reticle will not coincide. The result is misalignment of the object image with the image of the reticle which degrades the accuracy of optical instruments that are required to provide precise alignment of the object image with that of the reticle image."

Column 1 line 48 to column 2 line 12 of Skinner explains how a combined effect of a parallax error and lateral displacement of the user's eye from the optical axis can negatively affect the accuracy of a projectile device as follows:—

"In riflescopes, parallax error is generated by the instrument being focused at a distance different from that of the target being viewed thereby in combination with the lateral displacement of the operator's eye from the optical axis. The importance of centering the eye on the optical axis of the riflescope is extremely important and is easily demonstrated. Typically, riflescopes have an eye relief of three inches to allow adequate space between the rear of the scope and the shooter's eye so that, when the rifle is discharged, the apparatus does not travel far enough back under recoil to strike the shooter's face. Considering a reasonably close target distance of one hundred yards, a one-degree deviation of the shooter's eye off-axis (a mere 0.087" [2.2 mm] to one side) will result in a parallax error at the target of sixty-three inches. In other words, the aim is off by a distance of over five feet even though the shooter may have, otherwise, perfectly aligned the image of the crosshairs with the image of the target. Targets at greater distances will generate increasingly greater parallax error. Thus, in the example given, if the distance is increased to 200 yards, the error would double to over ten feet.

Thus, when these two negative factors, parallax and displacement of the operator's eye from the optical axis, are combined, as they often are, the resulting error can be overwhelmingly great. The prior art has failed to provide visual feedback to the operator of the presence of these deleterious conditions. Until the present invention, there has been absolutely no way for the operator of instruments of these classes to be alerted to these negative conditions. The present invention remedies these defects of the prior art by providing visual indicators that serve to neutralize these negative factors that work against the accuracy of these instruments."

Figure 5:
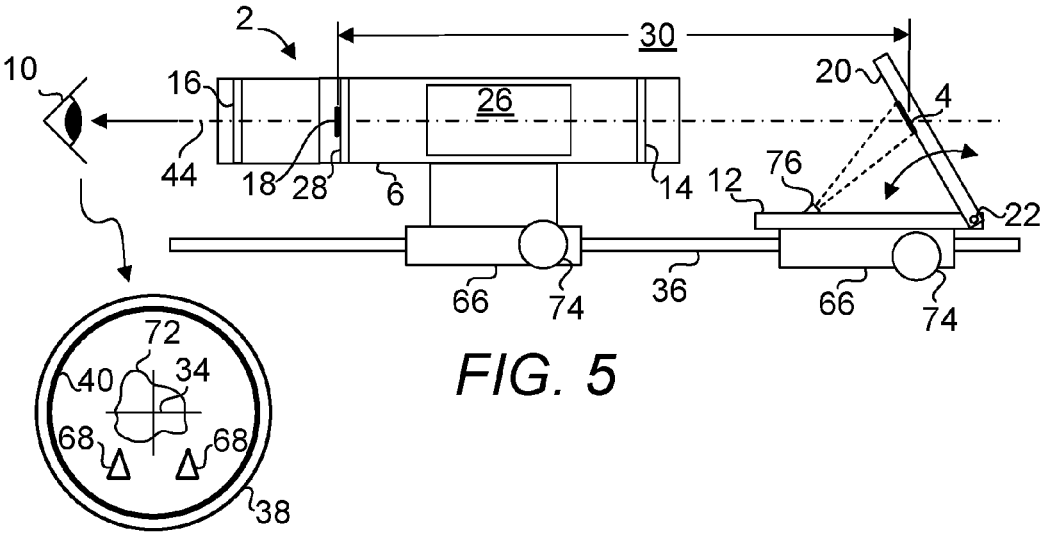
FIG. 5 is a diagrammatic side view of one embodiment of a sight aid adapted for use with a scope, where a projection device is separately provided.

FIGS. 5-11 and 21 are side views of various embodiments of the present sight aid. In order to further clarify the image as viewed through the scope of each instance, a sight picture is also included in each of these figures. Disclosed herein is a sight aid for aiding aiming, e.g., solving aiming problems discussed in Skinner and zeroing of a projectile device with respect to a target, which not only solves parallax errors but also provides reference points for zeroing of the projectile device. The present sight aid can be adapted to an existing telescope or it can be integrally designed and built into a telescope. Reference is made to Applicant's U.S. Pat. No. 8,769,858 for the apparatus and method used for zeroing a projectile device. The present sight aid is adaptable to a scope having a housing 6, an objective lens 14 mounted in the housing 6 at one end thereof for forming a target image and an ocular lens 16 mounted in the housing 6 at opposite end thereof and image-erecting optics 26. The objective and ocular lenses 14, 16 define an optical axis 44 through the housing 6 and the image-erecting optics 26 are mounted between the objective and ocular lenses 14, 16 on the optical axis 44 for erecting the image formed by the objective lens 14, the ocular lens 16 sharing a plane of focus on the optical axis 44 where the erected image is formed for viewing by the user 10. A reticle 28 is mounted within the housing 6 on the plane of focus, the reticle 28 having a sight alignment indicator 18 on the optical axis 44, an image thereof being viewable together with the target image formed by the objective lens 14 and the image-erecting optics 26 within the housing 6 to facilitate alignment of the scope with the target 72. The sight picture of FIG. 5 shows two indicators 4, 18, one having a set 18 of crosshairs 34 and the other 4 having a ring 40. FIG. 5 depicts the supplementary sight alignment indicator as a projected image including a ring. However, various other images may be made available for a user's choosing. The supplementary sight alignment indicator (ring-shaped) is one example of a projected image shaped concentrically to the sight alignment indicator that is crosshairs-shaped, so that, when a user's eye is centered on the optical axis, the image of the supplementary sight alignment indicator is centered relative to the sight alignment indicator. In one embodiment, the ring appears as a bright laser-projected image, the ring is useful for attracting the attention of a user's eye such that undue effort in focusing one's eye in establishing alignment of the scope with a target can be avoided. As such, the user can expediently identify visually the ring with the crosshairs 34 and the edge of the image cast by the objective lens, enabling the user to quickly acquire and center the target. Other suitable images for the supplementary sight alignment indicators include, but not limited to, a cross, a dot, a line or post, a plurality of lines, a pin or any combinations thereof. A post is preferably in many occasions, as it can be used to indicate orientation in addition to its use to indicate alignment. Any deviations from an expected orientation can be clearly shown with a post as it is rectilinear. The longitudinal ends of a post may also be used to indicate acquisition of positions when an end of the post becomes overlapped with a portion of the indicator 18. By contrast, dots are incapable of showing orientation although in some cases, they may be preferred by some users, especially those who have grown accustomed to using them in their prior experiences. In another example, the supplementary sight alignment indicator is a projected image shaped and sized substantially alike so that, when a user's eye is centered on the optical axis, the image of the sight alignment indicator completely covers the image of the supplementary sight alignment indicator. In this case, the supplementary sight alignment indicator can be crosshairs of identical dimensions to the crosshairs of the sight alignment indicator 18. In yet another example, the sight alignment indicator 18 may not be crosshairs but other shapes considered suitable for aiming. In this case, the supplementary sight alignment indicators may be manufactured to suit the shape and size of the sight alignment indicators.

It shall be noted that, along with the aiming alignment indicators, there is further provided at least one reference point 68 configured for superimposing at least one pre-printed reference point in the line of sight of a user. The zeroing reference points 68 may be selectively displayed. The sight aid includes a projection plane 20 and a projection device adapted to project a supplementary sight alignment indicator 4 and at least one reference point 68 by laser on the projection plane 20. In some embodiments, only one reference point 68 is necessary although two or more reference points provide enhanced results in zeroing. A suitable reference point is a projected image including a cross, a dot, a ring, a triangle or any combinations thereof.

The supplementary sight alignment indicator 4 is axially-centered with regard to the sight alignment indicator and spaced apart therefrom on the optical axis 44 for forming a composite image with the image of the sight alignment indicator 18, the target image being viewable together by the user by means of the ocular lens 16 and the projection plane 20 is disposed at a distance from the sight alignment indicator 18. In some embodiments, the projection plane is formed of transparent phosphors coating to enable proper acquisition of the projection of the supplementary sight alignment indicator. The images of the sight alignment indicator and supplementary sight alignment indicators are aligned by the user to eliminate parallax error relative to the target image to ensure accurate alignment of the optical axis of the telescope with the target. The present sight aid makes alignment of the scope on target more precise as the present sight aid is capable of being mounted at a position spaced farther from an existing or primary reticle 28, thereby increasing the sensitivity at which a deviation from alignment of the reticle and the sight aid can be detected. Corrective actions can thus be taken more readily. For simplicity, the image as viewed by the user, is said to have been obtained from the projection of a light emitter onto a projection plane. However in reality, the image as viewed by the user, is an image superposed on a target.

It can be summarized that in one embodiment, the present sight aid can be used in the following manner to aid in aiming of a projectile device functionally coupled with a telescope having a primary sight alignment indicator carried in a reticle, an objective lens and an optical axis. A sight aid having an illuminated supplementary sight alignment indicator is first provided. The sight aid is then disposed forward of the objective lens such that the supplementary sight alignment indicator is centrally located with respect to the optical axis and the supplementary sight alignment indicator is disposed at a distance from the primary sight alignment indicator. The telescope is then pointed at the target. An image of the target is then centered on the optical axis. A composite image of the primary sight alignment indicator and the supplementary sight alignment indicator to one another and the image of the target is then centered so as to perfect aim of the scope with respect to the target.

FIG. 5 is a diagrammatic side view of one embodiment of a sight aid adapted for use with a scope, where a projection device is separately provided. In this embodiment, the scope 2 is mounted on a rail 36 via an adaptor 66 and releasably locked via a lock 74. The supplementary sight alignment indicator 4 is axially-centered with respect to the sight alignment indicator 18. The rail 36 extends sufficiently long forward to accommodate the projection device 12 similarly secured to the rail 36. The rail 36 is in turn fixedly secured to a projectile device. In this embodiment, the projection device 12 includes a projector 76 useful for projecting an image in the form of a supplementary sight alignment indicator 4 on a projection plane 20. The projection device 12 is configured to be removable while not in use or when highly precise alignment is unnecessary, by unlocking the adaptor 66 and sliding the projection device 12 off the rail 36. While not in use, the flip-mounted projection plane 20 may be collapsed upon the projection device 12 about hinge 22 to protect the projection plane 20 from accidental impact.

Figure 6:
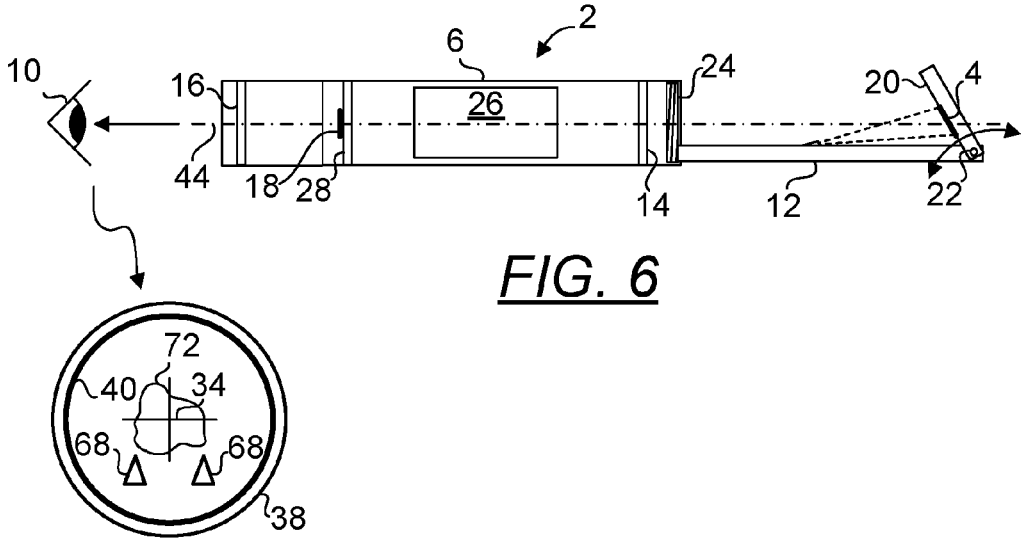
FIG. 6 is a diagrammatic side view of one embodiment of a sight aid adapted for use with a scope, where a projection device is integrally attached to the scope.

FIG. 6 is a diagrammatic side view of one embodiment of a sight aid adapted for use with a scope, where a projection device is integrally attached to the scope. The sight picture obtained contains similar images to those depicted in FIG. 5. The projection device is however one which is integrally but removably attached to the housing 6 via an attachment interface 24. In the embodiment shown, the attachment interface 24 is screw threaded and adapted to be coupled to mating screw threads on the housing 6. When not in use, the projection plane 20 is simply folded upon itself and the projection device is "unscrewed" from the objective lens end of the housing 6.

Figure 7:
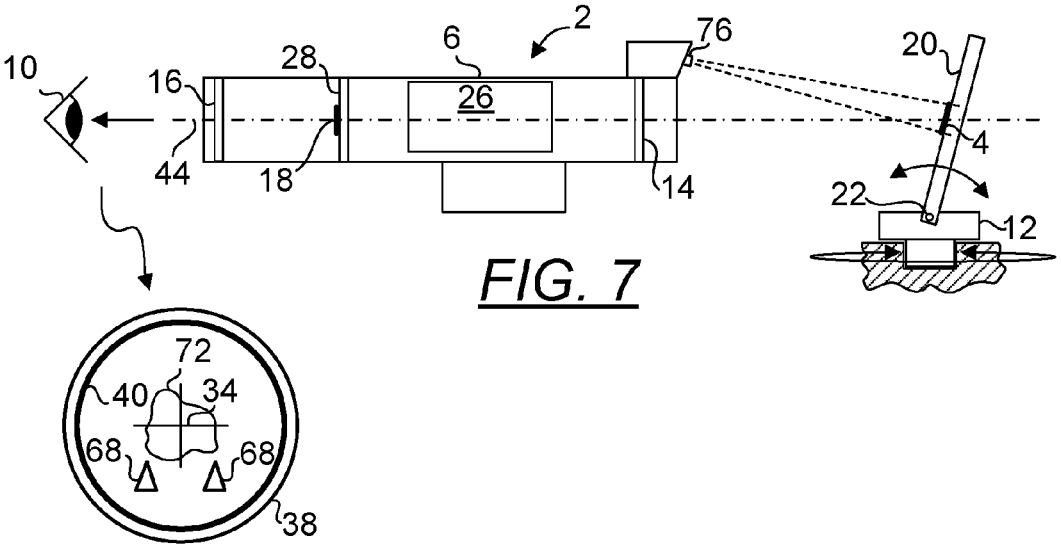
FIG. 7 is a diagrammatic side view of one embodiment of a sight aid adapted for use with a scope, where a projector is integrally attached to the scope while a projection plane is separately provided.
Figure 8:
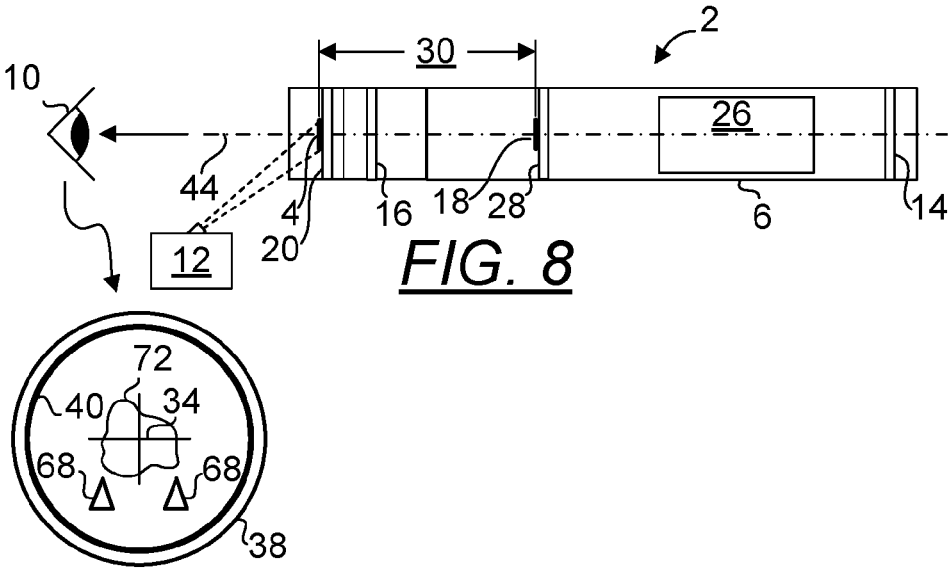
FIG. 8 is a diagrammatic side view of one embodiment of a sight aid adapted for use with a scope, where an illuminated device is separately provided.

FIG. 7 is a diagrammatic side view of one embodiment of a sight aid adapted for use with a scope, where a projector is integrally attached to the scope while a projection plane 20 is separately provided. The sight picture obtained contains images similar to those depicted in FIG. 5. The projector 76 can be removably mounted on the housing 6 or integrally built as part of the housing such that its projection is pointed forward and into a portion of the optical axis 44. A projection device 12 includes a rotatable base and a projection plane 20 flip-mounted to the rotatable base. The rotatable base allows the projection device to be disposed in an orientation convenient for stowage even when the projection device is left on a projectile device to which the projection device is mounted after use. FIG. 8 is a diagrammatic side view of one embodiment of a sight aid adapted for use with a scope, where an illuminated device is separately provided. In this embodiment, the supplementary sight alignment indicator 4 is projected onto a projection plane 20 disposed behind the ocular lens 16.

Figure 9:
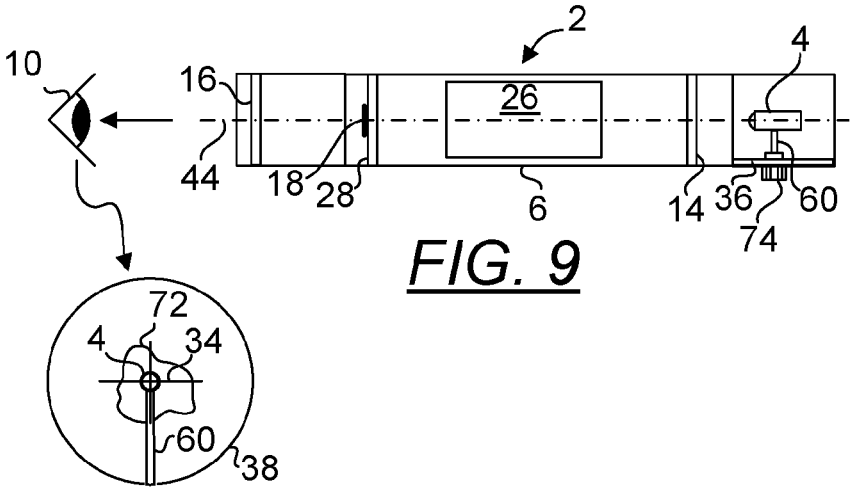
FIG. 9 is a diagrammatic side view of one embodiment of a sight aid adapted for use with a scope, where an illuminated device is integrally attached to the scope.
Figure 10:
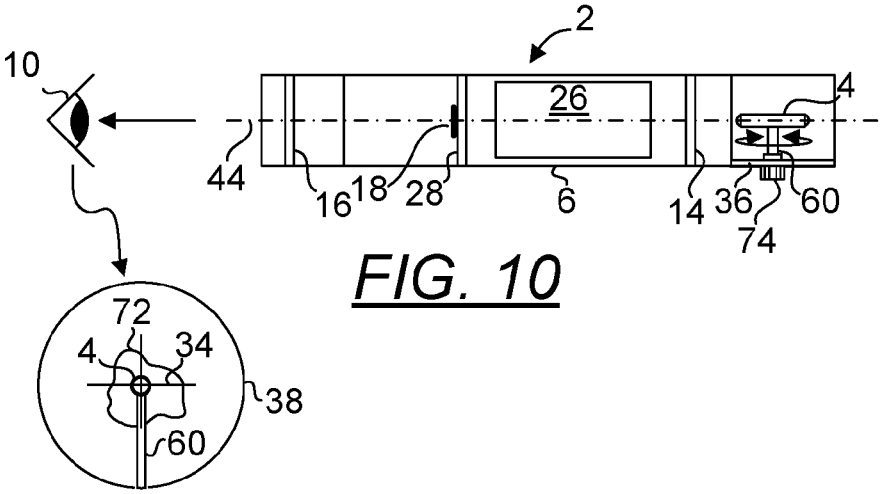
FIG. 10 is a diagrammatic side view of another embodiment of a sight aid adapted for use with a scope, where an illuminated device is integrally attached to the scope.

FIG. 9 is a diagrammatic side view of one embodiment of a sight aid adapted for use with a scope, where an illuminated device is integrally attached to the scope. FIG. 10 is a diagrammatic side view of another embodiment of a sight aid adapted for use with a scope, where an illuminated device is integrally attached to the scope. An illuminated indicator, e.g., via Light Emitting Diode (LED), incandescent light or transparent fluorescent material may be supported on a thin support post 60 and serve as the supplementary sight alignment indicator. The sight aid also may be disposed behind the image-erecting optics 26, i.e., on the ocular lens end of the scope in order to serve similar utility. The sight aid shown in FIG. 10 is similar to the one shown in FIG. 9 with the exception that the indicator of FIG. 10 is a bar equipped with an illuminating device on each of its longitudinal ends and the bar is rotatable on the support post 60 such that the user may select the preferred end. Among other color selections, two commonly preferred LED varieties available for use are red and green LEDs. Therefore one end may be equipped with a green LED and the other, a red LED. In one embodiment, the support post 60 is slidingly and removably disposed on a rail 36. Upon finding a preferable position of the support post 60 along the rail 36, a lock 74 can be used to secure the support post position by e.g., tightening the support post 60 to the rail 36.

FIG. 11 is a diagrammatic side view of another embodiment of a sight aid adapted for use with a scope, where a location-adjustable sight alignment indicator is integrally attached to the scope. FIG. 12 is a front view of a supplementary slight alignment indicator 4 mounted on a base 46, where the supplementary slight alignment indicator 4 is configured for sliding and removable attachment to a rail 36. A housing segment containing the supplementary sight alignment indicator 4 may be adapted to the housing 6 by first removing the ocular lens cap 54 and attaching the housing segment containing the supplementary sight alignment indicator 4 by mating threads on each end of the housing. There is provided a supplementary sight alignment indicator that can be aligned along an optical axis of a scope and be adjustable along the optical axis such that the indicator can be disposed on a plane of focus to yield clear views of the supplementary sight alignment indicator in sight pictures. Distance 32 can be adjusted to yield an image of the supplementary indicator that is of sufficient focus in sight pictures. In this embodiment, a rail 36 is provided to slidingly and removably receive a base 46 upon which a post 42 extends to a pointed end and intersects the optical axis. The pointed end aids a user in aligning the supplementary sight alignment indicator 4 with the sight alignment indicator 18 as the pointed end shall intersect the center of the crosshairs when alignment is achieved.

FIGS. 13-15 depict sight pictures of a scope having a reticle and a sight aid, one having a set of crosshairs and the other having a ring, when the user's eye is positioned on-axis and the user's eye is shifted off-axis. FIG. 13 shows good alignment as the ring 40 is congruous with the edge 38 of the image cast by the objective lens. FIG. 14 shows a result of lateral displacement of the user's eye to one side. FIG. 15 shows a result of lateral displacement of the user's eye to the opposite side. It shall be noted that, with the use of ring 40, congruity of the ring 40 with respect to the edge 38 of the image cast by objective lens can be easily determined as the elliptically-shaped rings 40 of FIGS. 14 and 15 quickly show incongruity.

Figure 16:
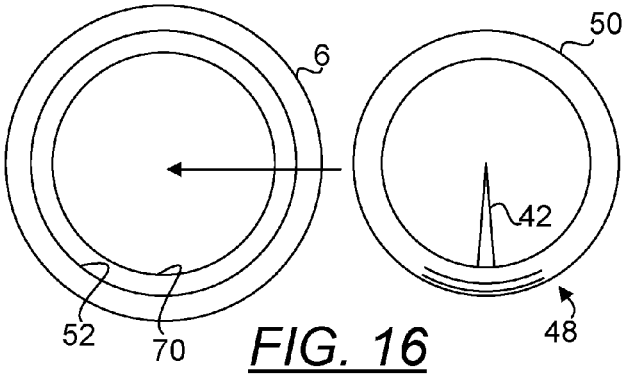
FIG. 16 is a diagram depicting another embodiment of the present sight aid and the cavity within which the sight aid is to be installed.
Figure 17:
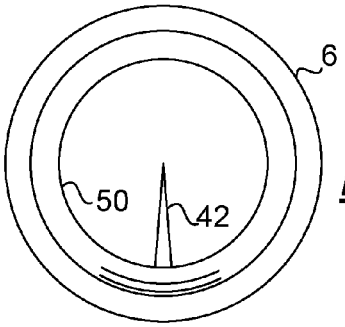
FIG. 17 depicts the sight aid of FIG. 16 having been installed in the cavity of the housing.

FIG. 16 is a diagram depicting another embodiment of the present sight aid and the cavity within which the sight aid is to be installed. FIG. 17 depicts the sight aid of FIG. 16 having been installed in the cavity of the housing 6. There is further provided one embodiment of the present sight aid that can be manufactured at low cost and insertable in numerous existing scopes. The sight aid 48 includes a resilient, substantially circular frame 50 having a supplementary sight alignment indicator 4, the cross-sectional shape of the frame being substantially elliptical or circular as well. In installing the sight aid 48, the frame is squeezed to deform in such a manner to fit into a cylindrical portion on the inner surface 52 of the housing of the scope. The frame is then released such that it can spring back into its original shape, placing the indicator 4 in the optical axis of the scope. In some telescopes, portions of the housing 6 may further be constructed to include ribs 70 to achieve structural rigidity of the housing 6. If a rib 70 is available, a sight aid 48 may be butted against it such that there is no doubt that when the sight aid 48 is installed, the planes defined by its frame 50 are perpendicularly disposed to the optical axis of the scope.

Figure 18:
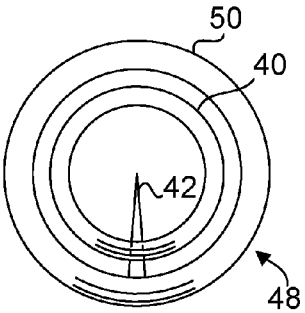
FIGS. 18-20 depict various embodiments of the present sight aid.
Figure 19:
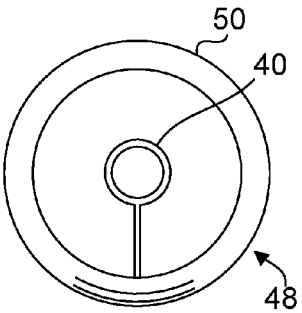
Figure 20:
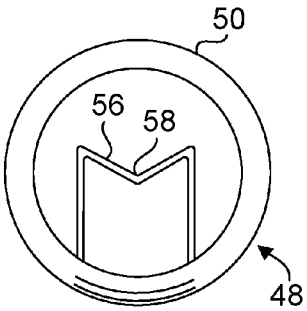
Figure 21:
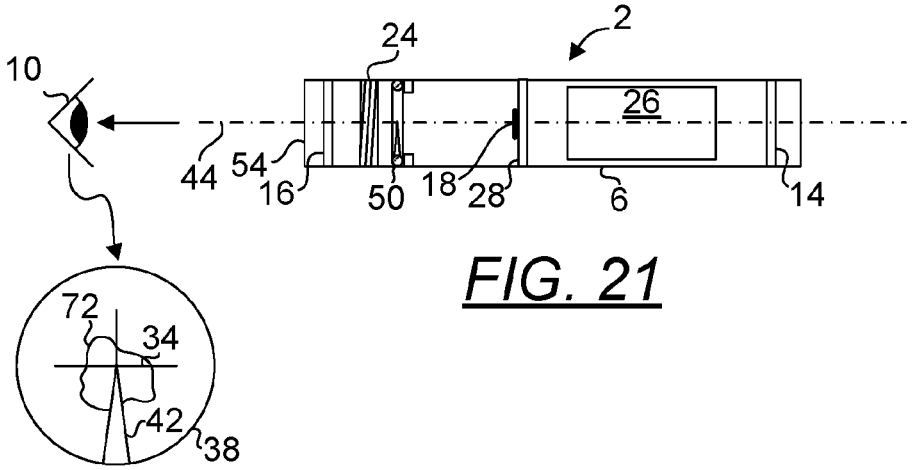
FIG. 21 is a diagrammatic side view of another embodiment of a sight aid of FIGS. 16-20 adapted for use with a scope, where the sight aid is integrally attached to the scope.

FIGS. 18-20 depict various embodiments of the present sight aid. FIG. 21 is a diagrammatic side view of another embodiment of a sight aid of FIGS. 16-20 adapted for use with a scope, where the sight aid is integrally attached to the scope. FIG. 18 depicts a supplementary sight alignment indicator having two components, i.e., a ring 20 and a pointed post 42 penetrating a portion of the ring 20 to keep it in place. Other means for creating a ring and a post combinations may also be used, e.g., fabricating the two components as a single piece. FIG. 19 depicts a ring 40 supported on a post. FIG. 20 depicts an "M-shaped" indicator 56 with the trough 58 of the indicator 56 intersecting the optical axis of a scope when installed.

Figure 22:
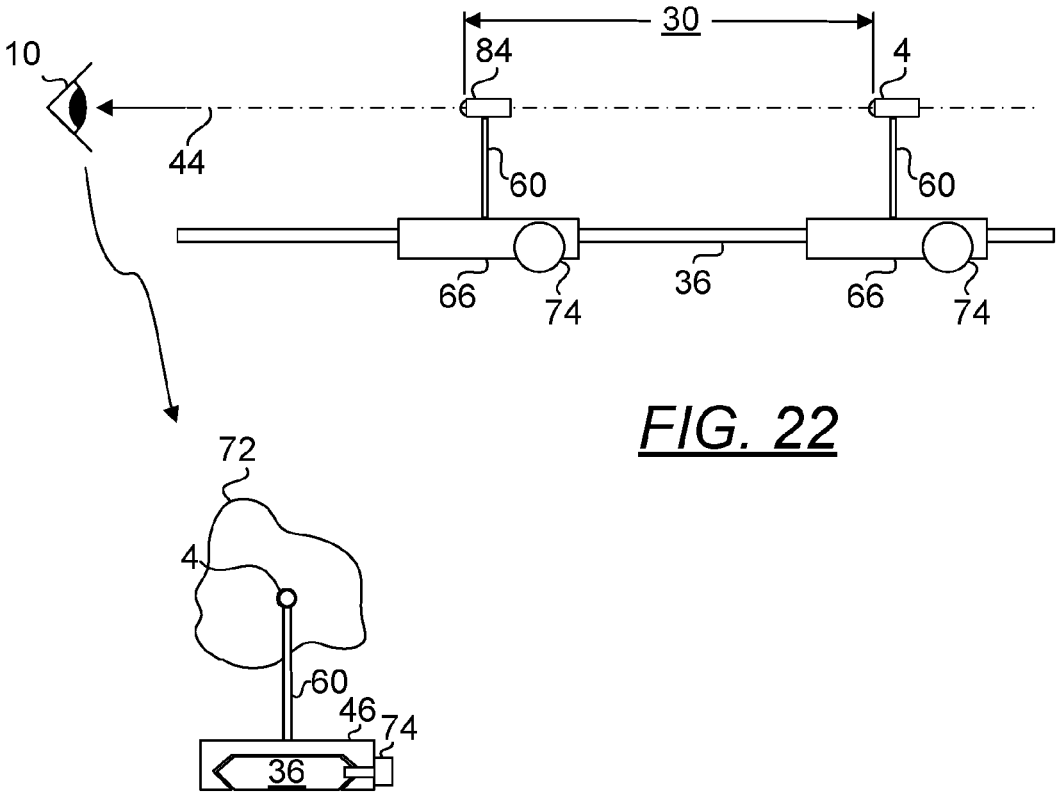
FIG. 22 is a diagrammatic side view of another embodiment of a sight aid having two illuminated posts.

For close-up targets, e.g., in the range of 0 up to about 25 yards, a telescope may not be necessary although a projectile device may be capable of significantly larger range than the close-up targets that the projectile device is used for. Therefore, a user may opt for one or more sight aids that are less expensive to procure and maintain. In many occasions, weight and space savings due to not having to carry a telescope with a projectile device also significantly reduces fatigue, especially of those users in combat situations. FIG. 22 is a diagrammatic side view of another embodiment of a sight aid having two illuminated posts. In this embodiment, two illuminated posts 84, 4 are mounted on a rail 36 such that their positions are alterable along the rail. Disposed atop each post is an illumination device, e.g., an LED. The illuminated posts are arranged such that the LEDs are disposed along an optical axis in a manner that its alignment with an eye of a user will cause a projectile of a projectile device to which the sight aid is coupled, to strike a target that is aligned with the optical axis. Any views obtained by a user via the alignment of his eye with the optical axis against a target are largely unobscured by the thin posts but rather drawn rapidly to the LEDs, facilitating the acquisition of the target and elimination of parallax. The light emitters shown in FIGS. 8 and 9 may also be used in the embodiment shown in FIG. 22. Other suitable illuminated indicators disposed atop the thin posts include, but not limited to, a fluorescent material and a transparent colored material.

Any embodiments of the present supplementary sight alignment indicators disclosed herein may be mounted on a rail, rendering them adjustable along the optical axis of a scope. Further, any embodiment of the illuminated type supplementary sight alignment indicators may also be mounted at a location conventionally made for iron sights provided that the supplementary sight alignment indicator is disposed in the optical axis.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A sight aid for aiding aiming of a projectile device with respect to a target, said sight aid consisting of:

(a) a telescope having a housing, an objective lens mounted in the housing at one end thereof for forming a target image, an ocular lens mounted in the housing at an opposite end thereof and having image-erecting optics, a reticle mounted within the housing, wherein the objective and ocular lenses define an optical axis through the housing and the image-erecting optics are mounted between the objective and ocular lenses on the optical axis for erecting the image formed by the objective lens, where the erected image is formed for viewing by a user, the reticle having a sight alignment indicator on the optical axis, an image thereof being aligned with the target image formed by the objective lens and the image-erecting optics within the housing to facilitate alignment of the telescope with the target; and (b) an illuminated supplementary sight alignment indicator supported on a support post, said illuminated supplementary sight alignment indicator is axially-centered with respect to the sight alignment indicator and spaced apart a distance therefrom along said optical axis for forming a composite image with said image of the sight alignment indicator and the target image being viewable together by the user by means of said ocular lens, said illuminated supplementary sight alignment indicator comprises at least one Light Emitting Diode (LED), whereby an indication of deviation of said images of the axially-centered sight alignment indicator and axially-centered illuminated supplementary sight alignment indicator and said target image along the optical axis is provided to the user such that an action can be taken to remove such deviation to assure accurate alignment of the optical axis of said telescope with the target; and wherein said illuminated supplementary sight alignment indicator is a bar having a first longitudinal end and a second longitudinal end, a first LED of said at least one LED is disposed on said first longitudinal end and a second LED of said at least one LED is disposed on said second longitudinal end, said bar is rotatably attached to said support post and said bar is configured to be rotatable about an axis that is substantially perpendicular to the optical axis and each of said first and second longitudinal ends is configured to be selectable by rotating said bar and pointing one of said first and second longitudinal ends towards the user and said bar is coaxially disposed with said optical axis.

2. A sight aid for aiding aiming of a projectile device with respect to a target, said sight aid comprising:

(a) a telescope having a housing, an objective lens mounted in the housing at one end thereof for forming a target image, an ocular lens mounted in the housing at an opposite end thereof and having image-erecting optics, a reticle mounted within the housing, wherein the objective and ocular lenses define an optical axis through the housing and the image-erecting optics are mounted between the objective and ocular lenses on the optical axis for erecting the image formed by the objective lens, where the erected image is formed for viewing by a user, the reticle having a sight alignment indicator on the optical axis, an image thereof being aligned with the target image formed by the objective lens and the image-erecting optics within the housing to facilitate alignment of the telescope with the target;

(b) a rail disposed substantially parallel to said optical axis; and (c) an illuminated supplementary sight alignment indicator supported on a support post adapted to be slidingly and removably coupled to said rail, said illuminated supplementary sight alignment indicator is axially-centered with respect to the sight alignment indicator and spaced apart a distance therefrom on said optical axis for forming a composite image with said image of the sight alignment indicator and the target image being viewable together by the user by means of said ocular lens and said distance being adjustable along said rail and said illuminated supplementary sight alignment indicator comprises at least one Light Emitting Diode (LED), whereby an indication of deviation of said images of the axially-centered sight alignment indicator and axially-centered illuminated supplementary sight alignment indicator and said target image along the optical axis is provided to the user such that an action can be taken to remove such deviation to assure accurate alignment of the optical axis of said telescope with the target; and wherein said illuminated supplementary sight alignment indicator is a bar having a first longitudinal end and a second longitudinal end, a first LED of said at least one LED is disposed on said first longitudinal end and a second LED of said at least one LED is disposed on said second longitudinal end, said bar is rotatably attached to said support post and said bar is configured to be rotatable about an axis that is substantially perpendicular to the optical axis and each of said first and second longitudinal ends is configured to be selectable by rotating said bar and pointing one of said first and second longitudinal ends towards the user and said bar is coaxially disposed with said optical axis.

3. A sight aid for aiding aiming of a projectile device with respect to a target, said sight aid consisting of:

(a) a first selectively illuminated sight alignment indicator having an illumination device disposed on a support post disposed at a first end of said projectile device; and (b) a second selectively illuminated sight alignment indicator having an illumination device disposed on a support post disposed at a second end of said projectile device, said second selectively illuminated selectively illuminated sight alignment indicator spaced apart from said first selectively illuminated sight alignment indicator, said first selectively illuminated sight alignment indicator and said second selectively illuminated sight alignment indicator defining an optical axis, wherein said second selectively illuminated sight alignment indicator is axially-centered with respect to the first selectively illuminated sight alignment indicator on the optical axis for forming a composite image of said first selectively illuminated sight alignment indicator, said second selectively illuminated sight alignment indicator and the target being viewable by a user, whereby an indication of deviation of said axially-centered first selectively illuminated sight alignment indicator and axially-centered second selectively illuminated sight alignment indicator and the target along the optical axis is provided to the user such that an action can be taken to remove such deviation to assure accurate alignment of the optical axis with the target; and wherein at least one of said first and second selectively illuminated sight alignment indicators is a bar having a first longitudinal end and a second longitudinal end, a first Light Emitting Diode (LED) is disposed on said first longitudinal end and a second LED is disposed on said second longitudinal end, said bar is rotatably attached to said support post and said bar is configured to be rotatable about an axis that is substantially perpendicular to the optical axis and each of said first and second longitudinal ends is configured to be selectable by rotating said bar and pointing one of said first and second longitudinal ends towards the user and said bar is coaxially disposed with said optical axis.

* * * * *